United States Patent [19]

Kozuki

[11] Patent Number: 5,042,355

[45] Date of Patent: Aug. 27, 1991

[54] ELECTRONIC MUSICAL INSTRUMENT HAVING AN AUTOMATIC RHYTHM PERFORMANCE FUNCTION

[75] Inventor: Koichi Kozuki, Hamamatsu, Japan

[73] Assignee: Yamaha Corporation, Hamamatsu, Japan

[21] Appl. No.: 369,652

[22] Filed: Jun. 21, 1989

[30] Foreign Application Priority Data

Jun. 23, 1988 [JP] Japan ..... 63-153373

[51] Int. Cl.[5] ..... G10H 1/18

[52] U.S. Cl. ..... 84/618; 84/656

[58] Field of Search ..... 84/DIG. 2, 635, 634, 84/656, 616, 618, 653, 656

[56] References Cited

U.S. PATENT DOCUMENTS 4,624,170 11/1986 Ohno ..... 84/635
4,706,538 11/1987 Yoshida ..... 84/DIG. 2
4,882,964 11/1989 Okamoto ..... 84/DIG. 2

FOREIGN PATENT DOCUMENTS 63-293595 11/1988 Japan .
63-293596 11/1988 Japan .

*Primary Examiner*—William M. Shoop, Jr.
*Assistant Examiner*—Brian Sircus
*Attorney, Agent, or Firm*—Spensley Horn Jubas & Lubitz

[57] ABSTRACT

An electronic musical instrument efficiently uses plural tone generation channels to generate both manual performance tones and automatic rhythm performance tones. The tone generation channels normally are used for manual performance tone generation. Tone generation channels for automatic rhythm performance are selected when automatic rhythm performance is designated. The tone generation channels are selected on the basis of non-use or least significance. After a required number of tone generation channels are selected for automatic rhythm performance, musical tone channel assignment is made. When stopping of automatic rhythm performance subsequently is designated, each tone generation channel selected for automatic rhythm performance is designated to return to normal use for generation of manual performance tones.

4 Claims, 10 Drawing Sheets

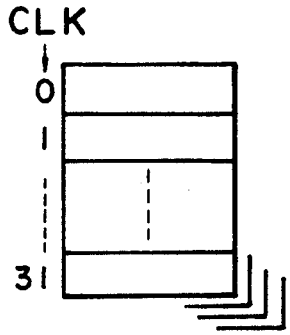
FIG. 3
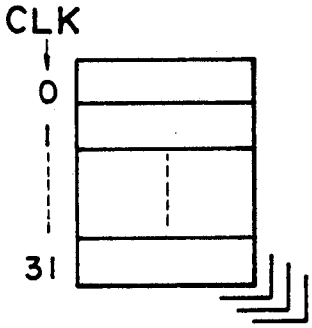
FIG. 4
| CHORD TYPE | PART TONES | | | | |
|---|---|---|---|---|---|
| | 0 | 1 | 2 | 3 | 4 |
| MAJOR | 1° | 3° | 5° | NONE | 1° |
| MINOR | 1° | 3b° | 5° | NONE | 1° |
| 7th | 1° | 3° | 5° | 7b° | 1° |
FIG. 5

ELECTRONIC MUSICAL INSTRUMENT HAVING AN AUTOMATIC RHYTHM PERFORMANCE FUNCTION

BACKGROUND OF THE INVENTION AND PRIOR ART

The present invention relates to an electronic musical instrument having an auto-rhythm (automatic rhythm) performance function.

A conventional electronic musical instrument having an auto-rhythm performance function has a keyboard (manual performance) sound source, and a rhythm sound source separately. For this reason, there is raised a problem that the auto-rhythm sound source is useless when a rhythm performance is stopped. In U.S. Pat. No. 4,706,538, there is disclosed an electronic musical instrument wherein sound generation channels for auto-accompaniment performance and manual performance are flexibly determined in keyboard sound source when a particular switch is on. However, in this instrument, a rhythm sound source is provided separately from the keyboard sound source. Thus, the abovementioned problem is not solved yet.

SUMMARY OF THE INVENTION

It is an object of the present invention to provide an electronic musical instrument which does not waste a sound source while a rhythm performance is stopped.

Recently, most sound sources used in an electronic musical instrument and the like can freely change tone colors every channel. The present invention employs a sound source (musical tone forming means) which can set tone colors for both a keyboard tone (key depression corresponding tone) and a rhythm tone every channel to commonly use tone generation channels for rhythm tones and manual (keyboard) tones and to flexibly determine channels exclusively used for an auto-rhythm performance when the auto-rhythm performance is started. More specifically, when an auto-rhythm start is instructed, a predetermined number of tone generation channels which less influence manual tones are selected from those used for manual tones so far, and are set for auto-rhythm tones. Tone color setting and channel assignment are independently performed for manual tone generation channels and auto-rhythm tone generation channels. Note that when an auto-rhythm stop is instructed, the tone generation channels set for the auto-rhythm tones are used for the manual tones.

In an auto-rhythm performance mode, since some tone generation channels are borrowed as the channels for generating auto-rhythm tones from those used for generating manual tones in a manual performance mode, the present invention has an advantage of effective use of a sound source by commonly using the tone generation channels. The borrowed channels are not predetermined but are selected from empty channels or channels having less influence such as channels in which musical tone levels are more decayed. Therefore, when an auto-rhythm performance is started in the middle of a manual performance, omission of some manual performance tones or mixing of click noise components can be avoided.

Among the tone generation channels for the auto-rhythm performance, every time key-on data of a rhythm tone is generated, tone generation channel assignment of the corresponding rhythm tone is performed. Therefore, the number of tone generation channels for the auto-rhythm performance can be smaller than the number of rhythm instruments necessary for performing an automatic performance of corresponding kinds of rhythm. For example, in an embodiment to be described later, a rhythm tone pattern consisting of 8 parts is generated using four tone generation channels.

BRIEF DESCRIPTION OF THE DRAWINGS

FIG. 3 shows a format of an ABC pattern in the electronic musical instrument shown in FIG. 1;

FIG. 4 shows a format of a rhythm pattern in the electronic musical instrument shown in FIG. 1;

FIG. 5 is a table showing chord constituting tones in the electronic musical instrument shown in FIG. 1;

DETAILED DESCRIPTION OF THE PREFERRED EMBODIMENT

An embodiment of the present invention will now be described with reference to the accompanying drawings.

Figure 1:
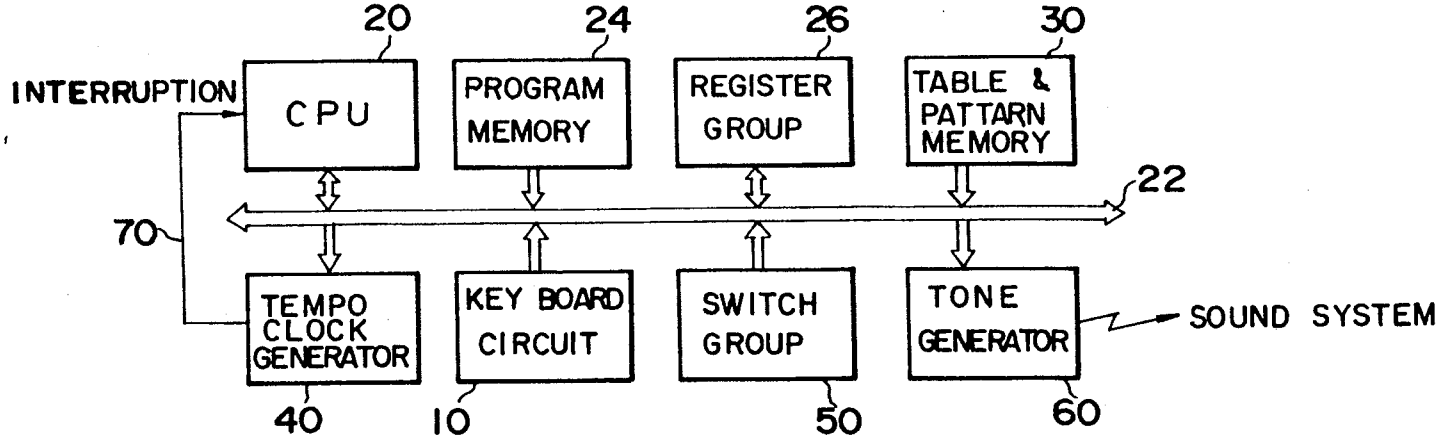
FIG. 1 is a block diagram showing a hardware arrangement of an electronic musical instrument according to an embodiment of the present invention.

FIG. 1 shows a hardware arrangement of an electronic musical instrument according to an embodiment of the present invention. This electronic musical instrument has a manual performance function for generating musical tones as keys are operated, an ABC (auto-bass chord) function for automatically performing accompaniment bass tones and chords on the basis of an accompaniment pattern stored in a pattern memory, and an auto-rhythm function for automatically performing rhythm tones on the basis of a rhythm pattern stored in the pattern memory. (Description of Arrangement of Electronic Musical Instrument in FIG. 1)

Figure 2:
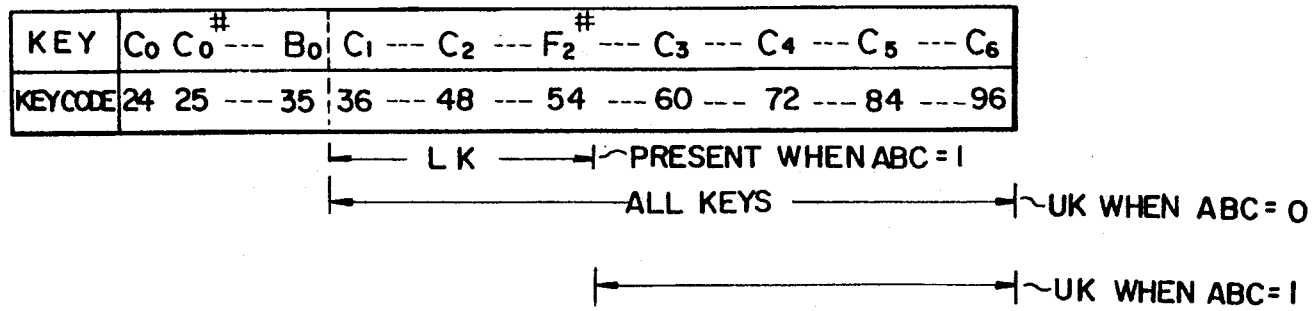
FIG. 2 is a table showing a correspondence between keys and key codes in a keyboard circuit shown in FIG. 1.

In FIG. 1, a keyboard circuit 10 detects a key-on event at a keyboard (not show), and generates key data (or a key code) representing a depressed key. The key code complies with the MIDI (Musical Instrument Digital Interface) standards, so that integer multiples of 12 (decimal notation), i.e., 36, 48, . . . , 96 are assigned to respective C tones in correspondence with positions $C_1$, $C\#_1$, $D_1$, . . . , $B_1$, $C_2$, . . . , $C_6$ of keys, and values which are incremented by one every half-tone are assigned to the remaining keys, as shown in FIG. 2. A (key) code representing a rest, i.e., a state wherein none of keys is depressed is "0". Note that numerical value data such as key codes are represented by decimal numbers unless otherwise specified.

The keyboard of this electronic musical instrument consists of 61 keys of $C_1$ to $C_6$. In the manual performance mode, all the keys serve as an upper keyboard (UK) for a melody performance. In an automatic accompaniment (ABC) mode, a key area is divided, so that 19 keys of $C_1$ to $F\#_2$ are used as a lower keyboard (LK) for designating chords, and 42 keys of $G_2$ to $C_6$ are used as the upper keyboard for the melody performance. In FIG. 2, the one-octave tone area of $C_0$ to $B_0$ falling outside the key area of this keyboard is used for bass tones in the automatic accompaniment mode.

The electronic musical instrument shown in FIG. 1 employs a central processing unit (CPU) 20 for controlling the overall operation of the instrument. The CPU 20 is connected through a bidirectional bus line 22 to the keyboard circuit 10, a program memory 24, a register group 26, a table & pattern memory 30, a tempo clock generator 40, a switch group 50, and a tone generator 60. The tone generator 60 is connected to a sound system constituted by an amplifier, a loudspeaker, and the like (not shown). A clock pulse output terminal of the tempo clock generator 40 is connected to an interruption signal input terminal of the CPU 20 through a signal line 70.

The program memory 24 comprises a read-only memory (ROM), and stores various control programs for, e.g., main processing, tempo interruption processing, and the like corresponding to the flow charts shown in FIGS. 6 to 16.

The register group 26 temporarily stores various data generated when the CPU 20 executes the control programs, and registers are set in predetermined areas of, e.g., a random-access memory (RAM).

Flags and registers constituting the register group 26 prepared in this electronic musical instrument will be described in an alphabetical order. Note that in the following description, the registers and their contents (data) are represented by identical labels unless otherwise specified.

1. ABC: 1/0 flag indicating ON/OFF of automatic accompaniment
2. ABCCH(0 to 4): 0 to 15 registers indicating correspondences between five parts of an automatic accompaniment pattern and channels
3. ASS: 0 to 15 register indicating a channel to be keyed on
4. ASSMD(0 to 15): 1, 2, 4, 8 registers each indicating one of a chord, bass tone, rhythm tone, and manual (key-on) tone to which a corresponding one of 0th to 15th channels is assigned by setting a corresponding bit to "1"
5. CHG: 1 to 15 register indicating a channel whose ASSMD (assigned tone color) is to be changed
6. CLK: 0 to 31 tempo clock register thirty-second note resolution
7. DCYCNT(0 to 15): 0 to 255 counters representing types of latest key-events of corresponding channels and generation order. The counters are arranged in correspondence with channels. Each counter is set to be "0" when a corresponding channel is keyed on, and to be "128" when it is keyed off. Thereafter, every time a key event occurs in another channel, the counter is incremented until lower 7 bits are all "1"s. More specifically, if the MSB is "0", it indicates a key-on state, and if it is "1", indicates a key-off state. As a count becomes larger, this indicates that a longer time has elapsed from occurrence of an event.
8. DCYMAX: 0 to 255 counter representing a maximum value of the counters DCYCNT(0 to 15)
9. EVKC register indicating a key code of a key making an event
10. i, j registers indicating control variables
11. KCBUF(0 to 15) buffers indicating key codes of channels assigned to the upper keyboard (UK)
12. KEY(0 to 4) registers indicating key codes to be generated on the lower keyboard (LK) on the basis of chord designation at the LK 0 to 3; chord tones (four tones) 4; bass tone (one tone)
13. LKBUF(0 to 3) buffers indicating key codes of four tones from a bass tone side of a key depressed at the LK
14. MAX register indicating a channel giving a maximum value of the DCYCNT of the UK (most decayed channel of the UK)
15. MIN register indicating a part indicating a smallest tone of channels assigned to rhythm tones
16. OFF register indicating a channel to be keyed off
17. RHY: 1/0 flag indicating ON/OFF of rhythm
18. RHYCH(0 to 3) registers indicating channels to which four rhythm parts are assigned
19. RHYCNT(0 to 3) counters indicating levels of four rhythm parts
20. RMIN register indicating a minimum value of the RHYCH(0 to 3)
21. RON: 1/0 flag indicating rhythm ON
22. ROOT: 0 to 11 register indicating a root of a chord
23. RSEL register indicating a selected rhythm type
24. TN register indicating a rhythm tone color
25. TYPE register indicating a chord type The table & pattern memory 30 comprises a ROM, and stores the following patterns and tables.

1. ABC pattern

PATA (chord type, clock, part)

As shown in FIG. 3, this pattern consists of a total of five parts, i.e., four chord parts (0th to 3rd parts) and a bass part (4th part). Each part is constituted by one measure of 8-bit (1-byte) data each representing a tone generation state at a timing corresponding to a thirty-second note, i.e., 32 bytes. As the 1-byte data representing the tone generation state, a key code (24 to 54) representing that a corresponding tone is at a key-on timing or is being subjected to tone generation, $00_H$ ("H" attached to a numerical value will represent hexadecimal notation hereinafter), and $FF_H$ indicating neither of these, i.e., no event, are stored. The memory 30 stores the ABC pattern for each of chord types M (major), m (minor), 7th (seventh), and the like for each rhythm type corresponding to the rhythm number RHY, i.e., a total of (the number of rhythm types) x (the number of chord types) patterns.

2. Rhythm pattern

PATR (rhythm type, clock)

As shown in FIG. 4, this pattern is provided for each rhythm pattern. The electronic musical instrument of this embodiment can use a maximum of eight types of rhythm instruments in units of rhythm types. One rhythm pattern consists of 32-byte data for one measure, each byte of which is assigned to a timing corresponding to a thirty-second note. Each bit of 1-byte data corresponds to one of eight rhythm instruments, and a 1/0 state of each bit represents the ON/OFF state of a corresponding instrument. The memory 30 stores one rhythm pattern for each rhythm type, i.e., patterns corresponding in number to the rhythm types.

3. Rhythm tone color table

RTONE (rhythm type, part)

This table represents a correspondence between each part (i.e., bit) of the rhythm pattern and a rhythm instrument. For example, if the rhythm type is "rock", a 0th bit indicates a bass drum, . . . , a 7th bit indicates a high hat, and if the rhythm type is "Latin", a 0th bit indicates an agogo, a 2nd bit, . . . , and so on. That is, this table indicates tone colors corresponding to bits in units of rhythm types.

4. Rhythm tone decay time table

RHYVL (tone color No.)

This table shows a decay time of each tone color (rhythm instrument tone). For example, a large value is assigned to one like a cymbal having a long decay time, and a small value is assigned to one such as a bass drum having a short decay time.

5. Chord constituting tone table

TBL (chord type, part)

This table shows a key code of each part of an ABC (auto-bass chord) when a rhythm performance is stopped. As shown in FIG. 5, a key code of each part is represented by an interval from a root ROOT in units of chord types TYPE.

The tempo clock generator 40 is a combination of a variable frequency oscillator or a fixed-frequency oscillator, and a frequency divider having a variable frequency division ratio, and generates 32 clock pulses per measure of a quadruple time. The clock pulses are input as an interruption signal to the CPU 20 through the signal line 70.

The switch group 50 comprises various operation switches disposed on an operation panel (not shown), e.g., an ABC switch for designating start and stop of an automatic accompaniment, a rhythm switch for designating start and stop of an automatic rhythm performance, a tempo switch for setting a tempo, tone color selection switches for the upper and lower keyboards, rhythm selection switches, a tone volume control, and the like.

The tone generator 60 comprises 0th to 15th, i.e., 16 tone generation (musical tone forming) channels capable of forming, a melody tone, chord tones, bass tones, and rhythm instrument tones, and forms musical tone signals on the basis of data of key-on, key-off, tone color (or instrument type), pitch (key code), and the like, and sends them to the sound system (not shown) comprising the amplifier and the like. The sound system generates musical tones on the basis of the musical tone signals.

Description of Operation of Electronic Musical Instrument in FIG. 1

The operation of the electronic musical instrument shown in FIG. 1 will be described below with reference to the flow charts of FIGS. 6 to 16.

When this electronic musical instrument is powered, the CPU 20 starts an operation in accordance with the control program stored in the program memory 24. First, the CPU 20 executes processing shown in the main routine of step 100 and subsequent steps in FIG. 6, and executes tempo interruption processing in FIG. 15.

1. Main Processing

Figure 6:
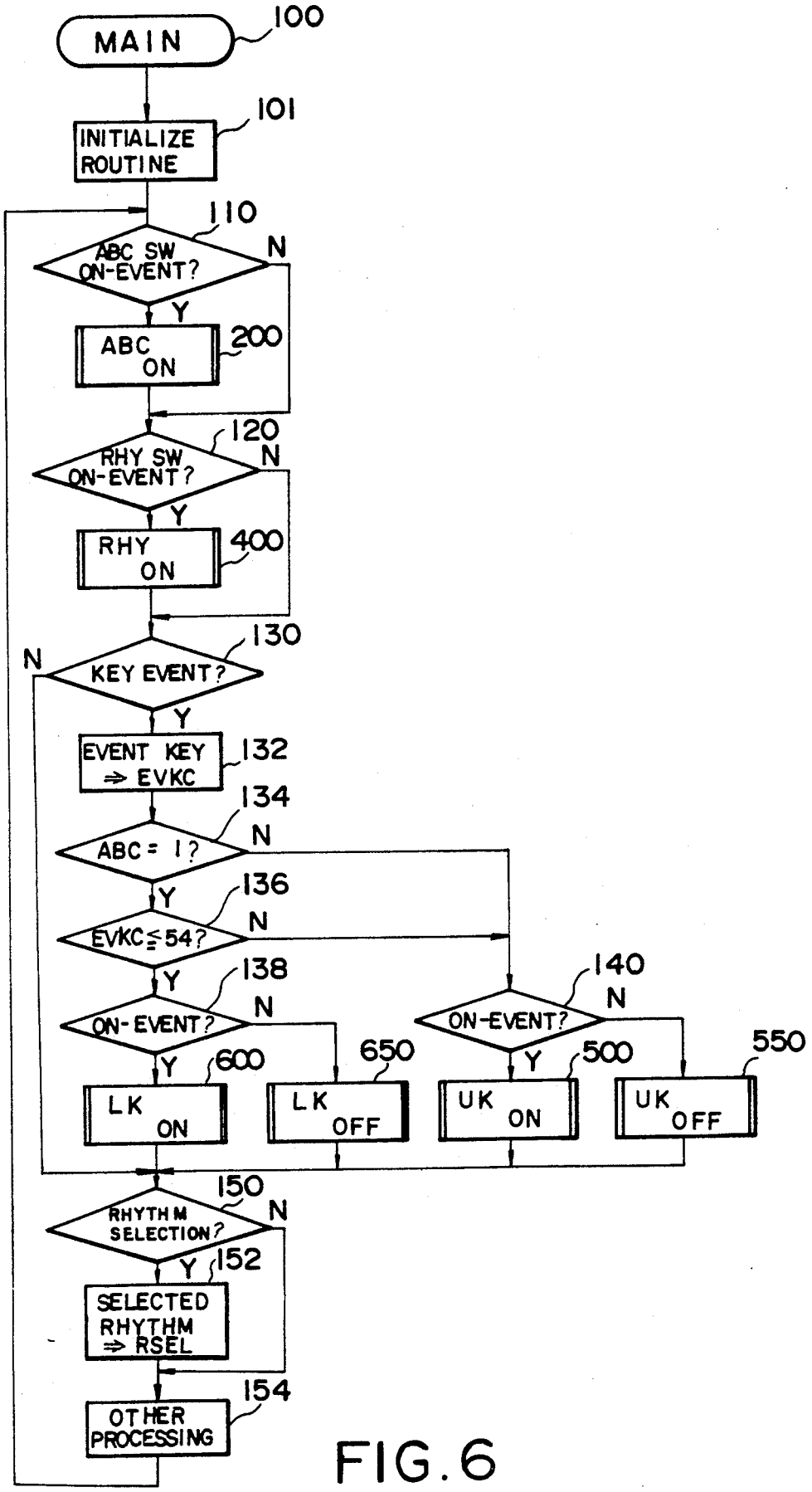
FIG. 6 is a flow chart of main processing of the electronic musical instrument shown in FIG. 1.

Referring to FIG. 6, initialization is performed in step 101. In this initialization, the automatic accompaniment ON/OFF flag ABC and the rhythm ON/OFF flag RHY are cleared, data $1_H$ is set in the tone color assignment registers ASSMD(0 to 15), data $FF_H$ is set in the decay counters DCYCNT(0 to 15), data $00_H$ is set in the rhythm tone level counters RHYCNT(0 to 4), and so on. Then, endless loop processing consisting of steps 110, 120, 130, 150, 154, and the like is executed.

In this loop processing, the outputs from the switch group 50 are checked in steps 110, 120, and 150. If an on-event of the ABC switch is detected in step 110, the flow branches to step 200, and the automatic accompaniment ON/OFF flag ABC is toggle-switched. As a result, if the flag ABC is set, ABC ON processing for searching and selecting five tone generation channels of the key-on tones from the presently most decayed one as the channels for the ABC is executed. Thereafter, the flow advances to step 120. On the other hand, if no on-event is detected, the flow directly advances from step 110 to step 120. If it is determined in step 120 that an on-event of the rhythm switch is detected, the flow branches to step 400, and the rhythm ON/OFF flag RHY is toggle-switched. As a result, if the flag RHY is set, rhythm ON processing for searching and selecting four tone generation channels of the key-on tones from the presently most decayed one as the channels for auto-rhythm is executed. Thereafter, the flow advances to step 130.

In step 130, the output from the keyboard circuit 10 is checked to determine the presence/absence of a key-event. If no key-event is detected, the flow directly advances from step 130 to step 150; if a key-event is detected, the flow advances to step 132. In step 132, a key code of the event key is stored in the register EVKC, and in step 134, the flag ABC is checked. If it is determined in step 134 that the flag ABC is "1", this means that the automatic accompaniment mode is selected. Since the keyboard is divided into the upper keyboard area (UK) and the lower keyboard area (LK), it is then checked in step 136 if the event key belongs to the LK. If a key code is equal to or smaller than 54, the corresponding key belongs to the LK. If Y (YES) in step 136, the flow advances to step 138 to check if an on-event is detected. If Y in step 138, the LK ON processing in step 600 is executed. If N (NO) in step 138, i.e., if an off-event is detected, LK OFF processing in step 650 is executed. Thereafter, the flow advances to step 150.

On the other hand, if it is determined in step 134 that the flag ABC is "0", that is, "NO" is obtained in step 134, the entire keyboard serves as the UK, and the key-event must belong to the UK. If "NO" in step 136, that is, the key code of the event key is equal to or larger than 55, the corresponding key belongs to the UK. In this manner, if the event key belongs to the UK, the flow advances to step 140 to check if the event is an on-event. If Y in step 140, UK ON processing in step 500 is executed; otherwise, UK OFF processing in step 550 is executed. Thereafter, the flow advances to step 150.

It is checked in step 150 if a rhythm selection is performed by the rhythm selection switch of the switch group 50. If Y in step 150, the flow branches to step 152, and a selected rhythm number is stored in the register RSEL. Thereafter, the flow advances to step 154. On the other hand, if N in step 150, the processing in step 152 is skipped, and the flow directly advances from step 150 to step 154.

In step 154, operation members such as the tone color switch, the tempo switch, the tone volume control, and the like are scanned. When events of these operation member are detected, keyboard tone color setting, tempo alteration, tone volume alteration processing, and the like are performed in correspondence with the detected events. After other processing in step 154 is executed, the flow returns to step 110, and the loop processing of steps 110 to 154 is repeated.

2. ABC ON Processing

If an on-event of the ABC switch is detected in step 110 of the main processing, ABC ON processing in step 200 is executed.

Figure 7:
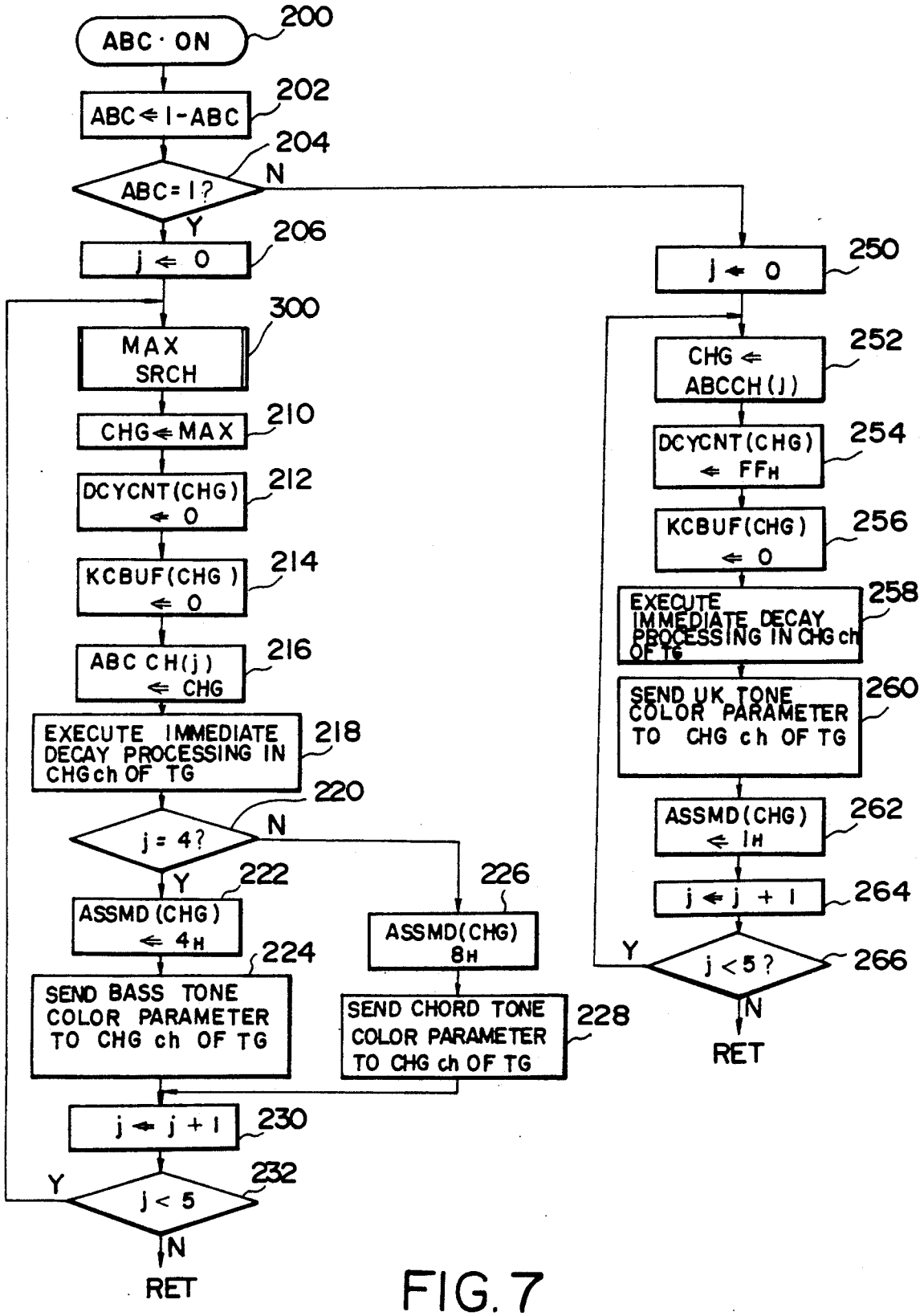
FIG. 7 is a flow chart of ABC ON processing of the electronic musical instrument shown in FIG. 1.

Referring to FIG. 7, in step 202, the flag ABC is inverted, and in step 204, the flag ABC is checked. If the flag ABC=1, since the ABC switch is turned on in the manual performance mode and as a result, the ABC mode is selected, processing in step 206 and subsequent steps is executed. On the other hand, if the flag ABC =0, since the ABC switch is turned on in the ABC mode and as a result, the manual performance mode is selected, processing in step 250 and subsequent steps is executed.

When the ABC mode is selected, the control variable j is set to be "0" in step 206. Thereafter, most decayed channel search processing in step 300 is executed so as to search for a tone generation channel (most decayed channel) MAX taking a maximum value of the decay counters DCYCNT(0 to 15) from tone generation channels set for generating tones of the UK keys. The values of the counters DCYCNT(0 to 15) are determined as follows. If a corresponding tone generation channel is an empty channel, the value is largest, i.e., $FF_H$; if it is a key-off channel, the value falls in the range of $80_H$ to $FF_H$; and if it is a key-on channel, the value falls in the range of $00_H$ to $7F_H$. As a lapse time after the key-off or key-on event is longer, the value becomes larger.

In step 210, a number MAX of this most decayed channel is stored in a changed channel number register CHG, and in step 212, a counter DCYCNT(CHG) of the most decayed channel CHG is cleared. In step 214, a key code buffer KCBUF(CHG) is cleared. In step 216, the channel number CHG indicating a tone generation channel to be assigned to a jth part is stored in a register ABCCH(j) of the jth part. In step 218, the key-on tone which is being generated in the channel CHG of the tone generator 60 is subjected to immediate decay processing. The number of a part for which processing is presently executed is then detected in step 220. In this embodiment, for the ABC, the 0th to 3rd parts are used for chord tones, and the 4th part is used for bass tones. Tone generation channel assignment is performed in the order named from the 0th part. Therefore, if the 4th part (j=4) is detected in step 220, since it is the bass tone part, $4_H$ indicating that the channel CHG is assigned to the bass tone is stored in a register ASSMD(CHG) in step 222. In step 224, a parameter of a bass tone color is sent to the (CHG)th channel of the tone generator 60. Thereafter, the flow advances to step 230.

If "NO" in step 220, i.e., the channel assignment processing of the 0th to 3rd parts (j=0 to 3) is being executed, since they are chord tone parts, $8_H$ indicating that the channel CHG is assigned to the chord tone is stored in the register ASSMD(CHG) in step 226, and a parameter of a chord tone color is sent to the (CHG)th channel of the tone generator 60 in step 228. Thereafter, the flow advances to step 230.

In step 230, the control variable j is incremented by one. It is checked in step 232 if tone generation channels for 0th to 4th, i.e., five parts necessary for the ABC are selected (j<5). If Y in step 232, the flow returns to the step next to step 206, and the above-mentioned processing in steps 300 to 232 is repeated. If N in step 232, the flow returns to step 120 in the main processing (FIG. 6). With the above-mentioned processing, five channels which are assigned for key-on tones so far are selected from the tone generation channels from a largest one of decay amounts, i.e., count values DCYCNT(0 to 15), and are switched for ABC tones.

If "NO" in step 204, i.e., the ABC switch is turned on in the ABC mode and as a result, the automatic accompaniment (ABC) mode is turned off, the tone generation channels assigned to ABC tone generation so far are switched to those for key-on tones by processing in step 250 and subsequent steps.

More specifically, the control variable j is set to be "0" in step 250, and a number ABCCH(j) of a channel for tone generation of the jth part is stored in the register CHG in step 252. In step 254, a decay value DCYCNT(CHG) of this channel CHG is set to be a maximum decay amount $FF_H$. In step 256, a key code KCBUF(CHG) to be generated in the channel CHG is cleared. In step 258, a bass or chord tone which is being generated in the channel CHG of the tone generator 60 is subjected to immediate decay processing. In step 260, a parameter of a UK tone color is sent to the channel CHG of the tone generator 60. In step 262, data $1_H$ indicating that the channel CHG is assigned to the key-on tone of the UK is set in the register ASSMD(CHG). In step 264, the variable j is incremented by one. Thereafter, the flow advances to step 266.

It is checked in step 266 if all the channels of the five parts assigned to the ABC are changed to those for key-on tones (j<5). If Y in step 266, the flow returns to step 252, and the above-mentioned processing in steps 252 to 266 is executed for the next jth part. If N in step 266, the flow returns to step 120 in the main processing (FIG. 6).

3. Most Decayed Channel Search Processing

This processing is performed to search a tone generation channel having a maximum decay amount DCYCNT of those for key-on tones so that tone generation channels borrowed as those for ABC and auto-rhythm are selected from the channels assigned to the key-on tones of 16 tone generation channels in the case of ABC ON and auto-rhythm ON.

Figure 8:
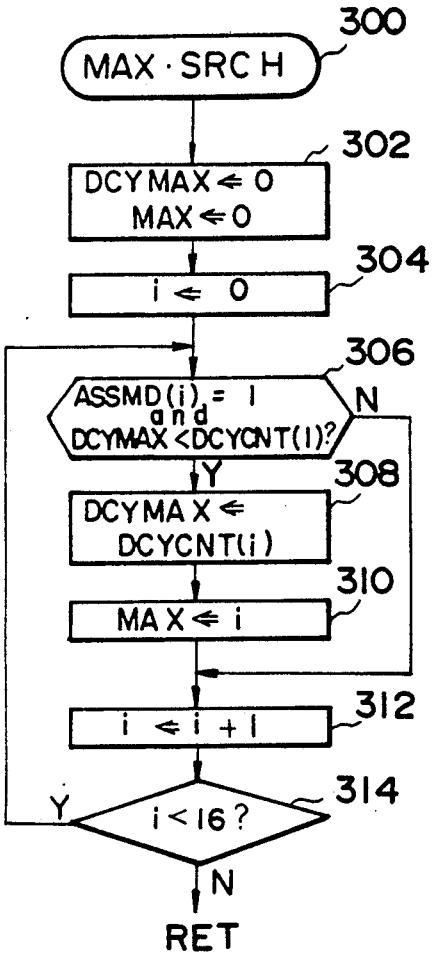
FIG. 8 is a flow chart of most decayed channel search processing of the electronic musical instrument shown in FIG. 1.

Referring to FIG. 8, a maximum decay value counter DCYMAX is set to be a minimum value "0", and a most decayed channel register MAX is set to be an initial channel "0", in step 302. In step 304, the control variable i is set to be "0". Thereafter, it is checked in step 306 whether or not a channel i is set for a key-on tone (ASSMD(i)=1) and whether or not a decay value DCYCNT(i) of a channel i is larger than the maximum DCYMAX of the already searched channels.

The most decayed channel search processing is performed to search one having a maximum decay value from channels for key-on tones, and to select tone generation channels borrowed as those for ABC or auto-rhythm tone generation. Therefore, if it is determined in step 306 that the channel i is not for the key-on tone and its decay value is smaller than other channels, the channel i is not considered for selection. Therefore, after step 306, the flow directly advances to step 312 while skipping steps 308 and 310.

On the other hand, if the channel i is for the key-on tone and its decay value is larger than a maximum decay value of the already searched channels, the flow advances to step 308, and the content of the counter DCYMAX is updated to DCYCNT(i). In step 310, the number i of the most decayed channel is registered in the register MAX. In step 312, the variable i is incremented by one. It is then checked in step 314 if search processing is completed for all the 16 tone generation channels (j<16). If N in step 314, the flow returns to the main processing. If Y in step 314, the flow returns to step 306, and the processing in steps 306 to 314 is repeated for the next channel i.

4. Rhythm ON Processing

In step 120 of the main processing, if an on-event of the rhythm switch is detected, rhythm ON processing in step 400 is executed.

Figure 9:
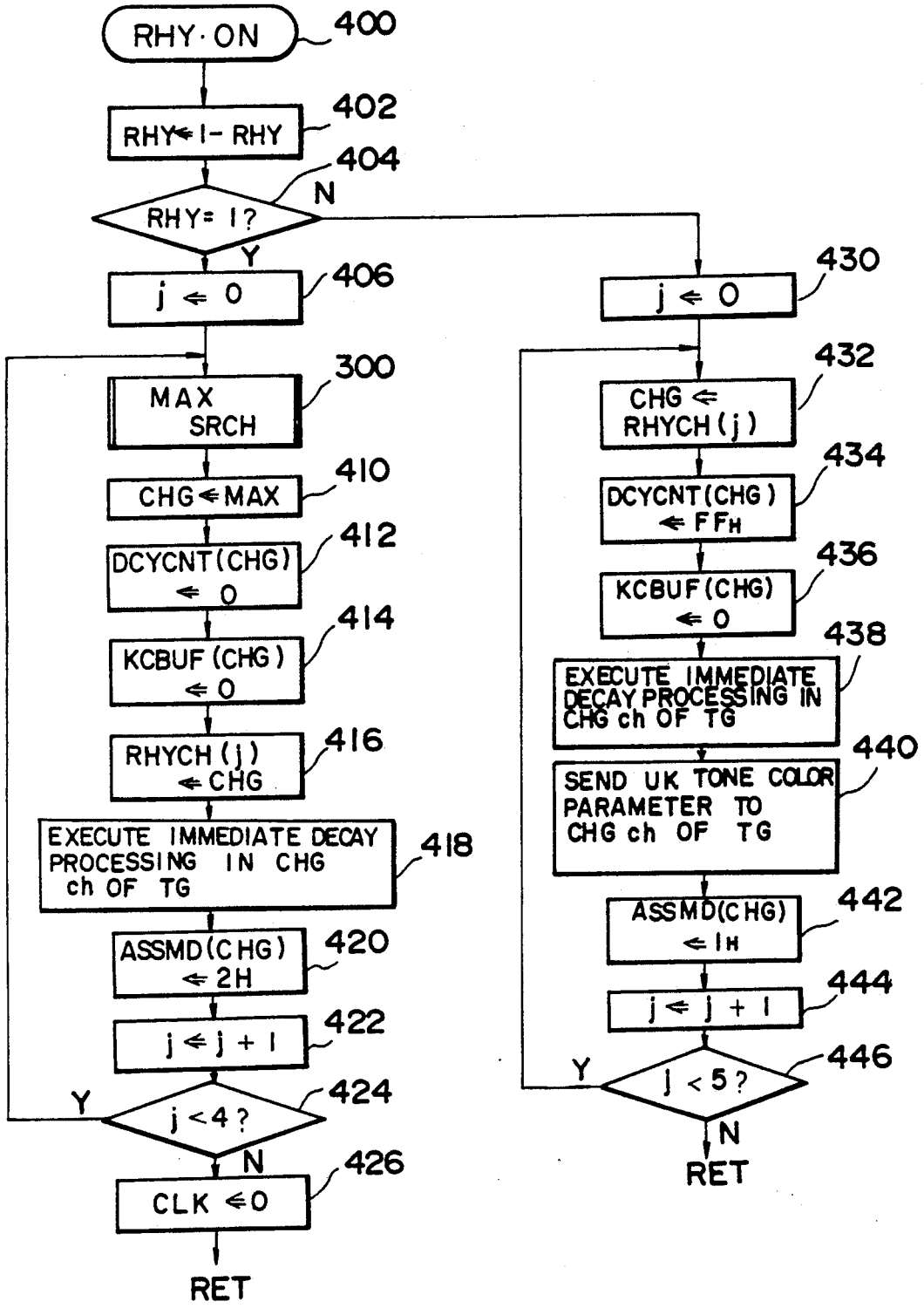
FIG. 9 is a flow chart of rhythm-ON processing of the electronic musical instrument shown in FIG. 1.

Referring to FIG. 9, in step 402, the rhythm ON/OFF flag RHY is inverted. In step 404, the flag RHY is checked. If the flag RHY=1, since the rhythm switch is turned on in the manual performance mode and as a result, the auto-rhythm mode is selected, processing in step 406 and subsequent steps is executed. If the flag RHY=0, since the rhythm switch is turned on in the auto-rhythm mode and as a result, the manual performance mode is selected, processing in step 430 and subsequent steps is executed.

When the auto-rhythm mode is selected, the control variable j is set to be "0" in step 406. Thereafter, the above-mentioned most decayed channel search processing in step 300 is executed to search the most decayed channel MAX having a maximum one of the decay values DCYCNT(0 to 15) from those set for tone generation of the UK keys.

In step 410, the number MAX of the most decayed channel is stored in the changed channel number register CHG. In step 412, a counter DCYCNT(CHG) of the most decayed channel CHG is cleared. In step 414, a key code buffer KCBUF(CHG) is cleared. In step 416, a channel number CHG indicating a tone generation channel which is assigned to a jth part is stored in a register RHYCH(j) of the jth part. In step 418, the key-on tone which is being generated in the channel CHG of the tone generator 60 is subjected to immediate decay processing. In step 420, data $2_H$ indicating that a rhythm tone is assigned to the channel CHG is stored in a register ASSMD(CHG). In step 422, the control variable j is incremented by one. Thereafter, it is checked in step 424 if tone generation channels for four, i.e., 0th to 3rd parts necessary for rhythm tones are selected (j<4). If Y in step 424, the flow returns to the step next to step 406, and the above-mentioned processing in steps 300 to 424 is repeated. If N in step 424, the clock CLK is cleared in step 426. The flow then returns to step 130 in the main processing (FIG. 6). With the above-mentioned processing, four tone generation channels having larger ones of the decay values DCYCNT(0 to 15), i.e., having less influence on the key-on tones are selected from those assigned to the key-on tones, and are switched to those for the rhythm tones.

If "NO" in step 404, i.e., if the rhythm switch is turned on in the auto-rhythm mode and hence the auto-rhythm mode is disabled, the tone generation channels assigned to the rhythm tones so far are switched to those for key-on tones by the processing in step 430 and subsequent steps.

More specifically, the control variable j is set to be "0" in step 430. In step 432, a number RHYCH(j) of a channel for tone generation of the jth part is stored in the register CHG. In step 434, a decay value DCYCNT(CHG) of this channel CHG is set to be a maximum decay amount $FF_H$. In step 436, a key code KCBUF(CHG) to be generated in the channel CHG is cleared. In step 438, a rhythm tone which is being generated in the channel CHG of the tone generator 60 is subjected to immediate decay processing. In step 440, a parameter of the UK tone color is sent to the channel CHG of the tone generator 60. In step 442, data $1_H$ indicating that the channel CHG is assigned to the UK key-on tone is set in a register ASSMD(CHG). In step 444, the variable j is incremented by one. The flow then advances to step 446.

In step 446, it is checked if all the channels for four parts assigned to rhythm tones are changed to those for key-on tones (j<5). If Y in step 446, the flow returns to step 432, and the above-mentioned processing in steps 432 to 446 is repeated for the next part j. If N in step 446, the flow returns to step 130 in the main processing (FIG. 6).

5. UK ON Processing

In step 140 of the main processing (FIG. 6), if a key-on event at the upper keyboard UK is detected, UK ON processing in step 500 is executed.

Figure 10:
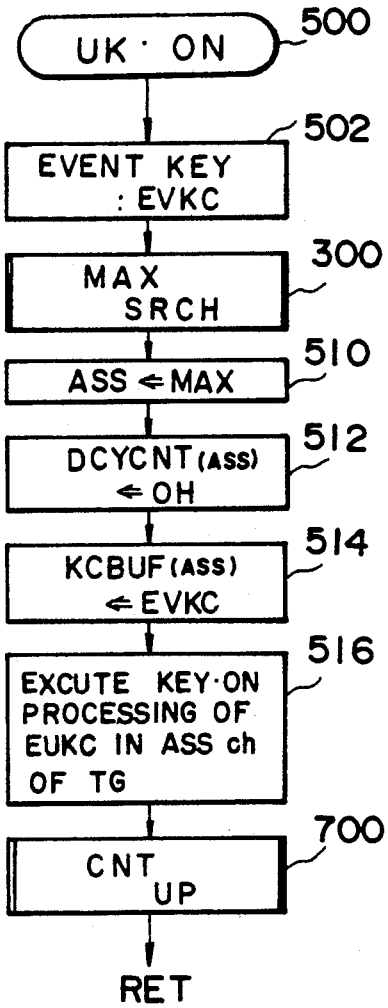
FIG. 10 is a flow chart of UK ON processing of the electronic musical instrument shown in FIG. 1.

Referring to FIG. 10, a key code of the event key is stored in the event key register EVKC in step 502. The number MAX of a channel having the maximum decay value is searched by the most decayed channel search processing in step 300. In step 510, the number MAX of the searched channel is stored in the tone generation channel register ASS, and the decay value of the channel ASS is set to be "0" indicating a state immediately after the key-on event. In step 514, the key code EVKC of the key-on tone is stored in a key code buffer KCBUF(ASS) of the corresponding channel ASS. Thereafter, key-on processing of the key code EVKC of the channel ASS of the tone generator 60 is executed in step 516. Count-up processing of a decay counter DCYCNT for each key-on tone channel is executed in step 700 (to be described later). Thereafter, the flow returns to step 150 in the main processing (FIG. 6).

6. Count-Up Processing

Figure 11:
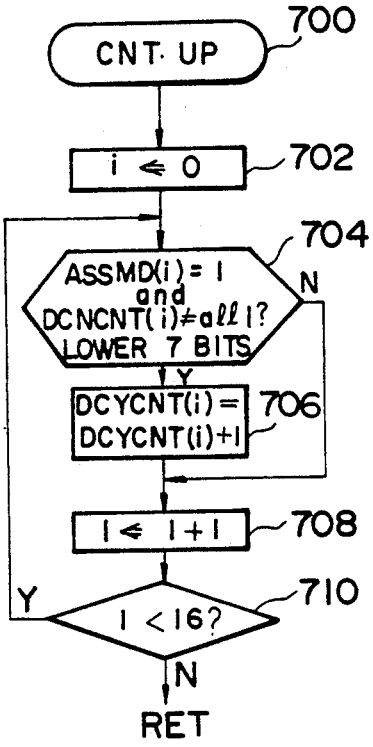
FIG. 11 is a flow chart of count-up processing of the electronic musical instrument shown in FIG. 1.

Referring to FIG. 11, in the count-up processing in step 700, the control variable i is set to be "0" in step 702. Thereafter, it is checked in step 704 if the channel i is set for a key-on tone (ASSMD(i)=1) and the lower 7 bits of the decay value DCYCNTC(i) are not all "1"s. If the channel i is set for the key-on tone and the lower 7 bits of the decay value DCYCNT(i) are not all "1"s, the count value of the counter DCYCNT(i) is counted up by one in step 706. Thus, the number of key events in other channels after a key event is made in the corresponding channel i is stored as a decay value in the lower 7 bits of the key-on tone.

On the other hand, if "NO" in step 704, that is, if the channel i is set for auto-rhythm or ABC tone generation (ASSMD(i)=2, 4, or 8) or the lower 7 bits of the DCYCNT(i) are all "1"s, the flow directly advances from step 704 to step 708 while skipping step 706. For the auto-rhythm and ABC tones, since the tempo clocks are counted to measure a lapse time, the count-up processing in step 706 is skipped. After the lower 7 bits of the decay value DCYCNT(i) are set to be all "1"s, the count-up processing in step 706 is also skipped. Thus, an overflow of the counter and a resultant erroneous count are prevented without increasing the number of digits of the counter. With this processing, 127 events can be counted, and a lapse time for 127 events is a time long enough for a musical tone to decay, resulting in less influence on key assignment and the like.

After the processing in step 706, or after step 706 is skipped in accordance with the judgement in step 704, the variable i is incremented by one in step 708. In step 710, it is checked if processing is completed for all the 16 tone generation channels ($i<16$). If N in step 710, the flow returns to the main processing. If Y in step 710, the processing in steps 704 to 710 is repeated for the next tone generation channel i.

7. UK OFF Processing

In step 140 in the main processing (FIG. 6), if a key-off event at the upper keyboard UK is detected, UK OFF processing in step 550 is executed.

Figure 12:
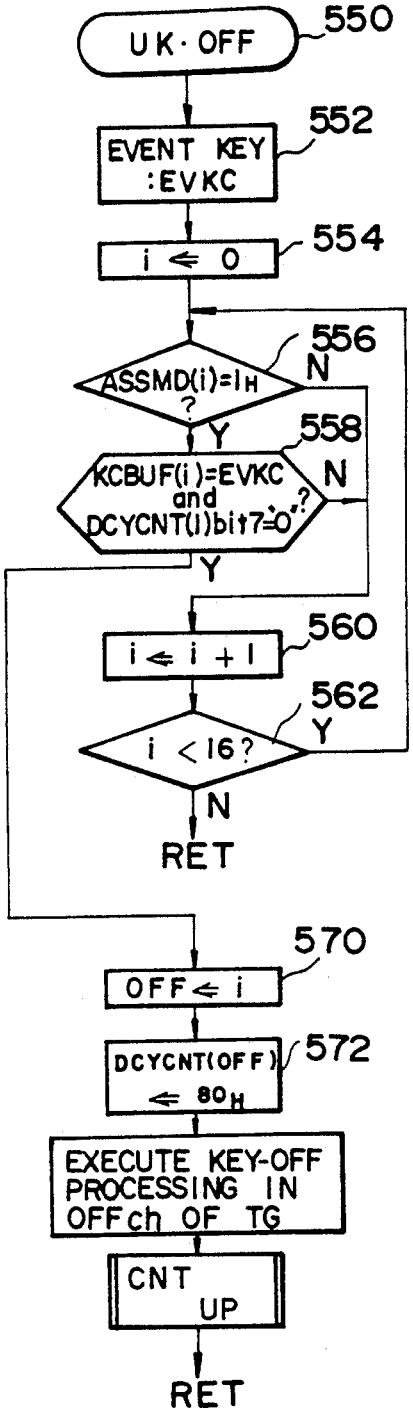
FIG. 12 is a flow chart of UK OFF processing of the electronic musical instrument shown in FIG. 1.

Referring to FIG. 12, a key code of the event key is stored in the register EVKC in step 552. Thereafter, a tone generation channel which is generating a key-on tone having a key code equal to the key-off key code EVKC is searched. More specifically, the control variable i is set to be "0" in step 554. It is then checked in step 556 if the channel i is assigned to a key-on tone. If Y in step 556, the flow advances to step 558 to check if the channel i is generating a tone (the MSB of the corresponding counter DCYCNT=0) and the keyed-off key code EVKC is equal to a key code KCBUF(i) of the tone being generated in this channel. If "YES" is obtained in both steps 556 and 558, the key-off event is made for this channel. In this case, the flow advances to step 570. If the channel i is assigned to a rhythm or ABC tone other than the key-on tone, "NO" is obtained in step 556, and the flow advances to step 560. If the key code EVKC is different from the key code KCBUF(i) or the MSB of the counter DCYCNT is "1", the flow also advances to step 560.

In step 560, the variable i is incremented by one, and it is then checked in step 562 if the variable i is smaller than 16. If the variable i is equal to or larger than 16, this means that there is no key-on channel corresponding to the key-off event. In this case, the flow returns to step 150 in the main processing (FIG. 6). That is, the key-off event is ignored. On the other hand, if it is determined in step 562 that the variable i is smaller than 16, unsearched channels still remain. Therefore, the flow returns to step 556, and the processing in step 556 and subsequent steps is executed for the next channel i.

If a channel corresponding to the key-off event is found and the flow advances to step 570, the channel number i is stored in the key-off channel register OFF in step 570. In step 572, the decay value of the channel OFF is set to be $80_H$ indicating a state immediately after a key-off event. Key-off processing is executed in the channel OFF of the tone generator 60. After key-on channels are counted up by the count-up processing in step 700, the flow returns to step 150 in the main processing (FIG. 6).

A musical tone can be generated by these UK ON processing (FIG. 10) and UK OFF processing (FIG. 12) as a key is depressed at the upper keyboard UK.

8. LK ON/OFF Processing

If a key-on event at the lower keyboard LK is detected in step 138 in the main processing (FIG. 6), LK ON processing in step 600 is executed.

Figure 13:
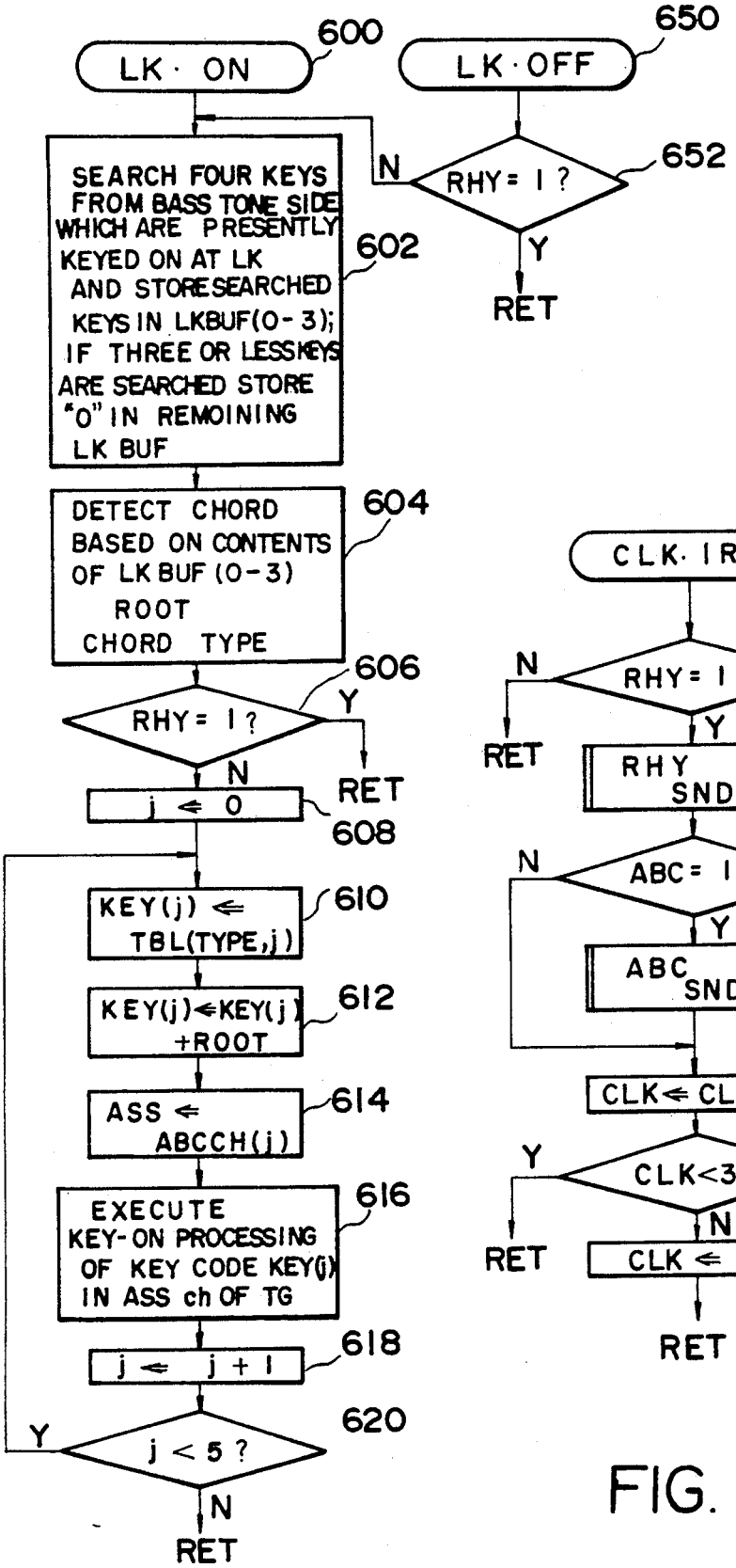
FIG. 13 is a flow chart of LK ON/OFF processing of the electronic musical instrument shown in FIG. 1.

Referring to FIG. 13, four keys from a bass tone side which are presently keyed on at the LK are searched in step 602, and are stored in the LK key code buffers LKBUF(0 to 4). However, if the number of key-on keys is smaller than 4, data "0" is set in the remaining buffers LKBUF. In step 604, a chord is detected on the basis of the contents of the buffers LKBUF(0 to 4), so that a root is stored in the root register ROOT, and a chord type is stored in the chord type register TYPE. Thereafter, the auto-rhythm ON/OFF flag RHY is checked in step 606. If RHY=1, since the auto-rhythm runs, the flow returns to step 150 in the main processing (FIG. 6). In this case, an ABC pattern is read out in accordance with a rhythm type and a chord type in addition to a rhythm pattern in tempo interruption processing (to be described later), and an auto-bass chord is performed on the basis of the ABC pattern.

If "NO" in step 606, i.e., if the auto-rhythm is stopped, key-on chord tone generation processing in step 608 and subsequent steps is executed.

More specifically, the control variable j is set to be 0 in step 608, and the chord constituting tone table TBL is referred to in step 610, so that interval data of a part j corresponding to the chord type TYPE is read out and stored in a buffer KEY(j). In step 612, root data ROOT is added to the interval data KEY(j), thereby converting it into a key code. In step 614, a tone generation channel number of the part j is read out from an automatic accompaniment channel number register ABCCH(j), and is stored in a key-on channel number register ASS. In step 616, key-on processing of the key code KEY(j) is performed in the channel ASS of the tone generator 60. The key-on processing is repeated for five parts j=0 to 4, thereby generating a chord and a bass tone as designated by the key-on operation at the lower keyboard.

More specifically, in step 618, the variable j is incremented by one. If it is determined in step 620 that j is smaller than 5, the flow returns to step 610, and the processing in steps 610 to 620 is repeated to perform tone generation processing for the next part j. If the processing for all the five parts is completed and j becomes equal to or larger than 5, the flow returns from step 620 to step 150 in the main processing (FIG. 6).

If a key-off event at the lower keyboard LK is detected in step 138 in the main processing (FIG. 6), the processing advances from step 138 to LK OFF processing in step 650. In step 652, the auto-rhythm ON/OFF flag RHY is checked. If RHY=1, since the auto-rhythm runs, the ABC pattern is read out as described above, and includes key-off data. Thus, no key-off data by the key event at the LK is necessary. Therefore, the flow returns to step 150 in the main processing (FIG. 6) directly from step 652. On the other hand, if RHY=0 in step 652, the flow advances to step 602 in the LK ON processing, and the key-off processing is performed as in the LK key-on state.

9. Tempo Interruption Processing

In this electronic musical instrument, clock interruption processing in step 800 is executed using, as an interruption signal, tempo clocks output from the tempo clock generator 40 at every 1/32 period of one measure in a quadruple time.

Figure 14:
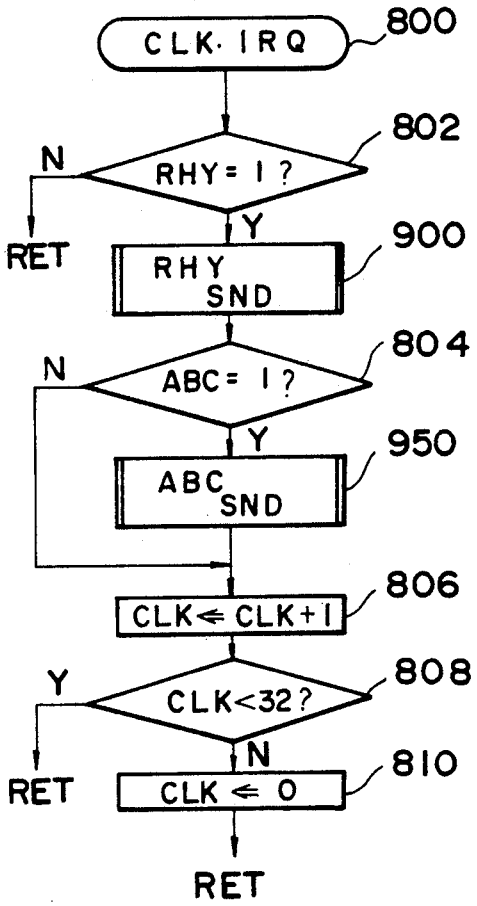
FIG. 14 is a flow chart of tempo interruption processing of the electronic musical instrument shown in FIG. 1.

Referring to FIG. 14, the auto-rhythm ON/OFF flag RHY is checked in step 802. If the flag RHY is "0", the auto-rhythm or ABC performance is not performed, and neither tone generation processing of a rhythm tone and a chord tone nor count processing of the tempo clocks are necessary. An interruption is immediately canceled, and the control returns to the main processing.

If the flag RHY is "1", since the automatic performance of rhythm and chord tones runs, rhythm tone generation processing (FIG. 15) in step 900 (to be described later) is executed on the basis of the rhythm type RSEL and the tempo clock CLK. In step 804, the automatic accompaniment ON/OFF flag ABC is then checked. If the flag ABC is "1", ABC tone generation processing (FIG. 16) in step 950 (to be described later) is executed on the basis of the rhythm type RSEL, the chord type TYPE, the tempo clocks CLK, and a part j (j=0 to 4), and the flow then advances to step 806. On the other hand, if the flag ABC is "0", the ABC tone generation processing is skipped, and the flow directly advances from step 804 to step 806.

In step 806, the tempo clock CLK is incremented by one, and it is checked in step 808 if the tempo clock CLK is smaller than 32. Since the tempo clock CLK is a cyclic number of 0 to 31 representing an intra-measure timing, if it is smaller than 32, the flow returns; otherwise, the tempo clock CLK is cleared to "0" in step 810, and the interruption is canceled. Thereafter, the control returns to the main processing.

10. Rhythm Tone Generation Processing

If it is determined in step 802 in the tempo interruption processing (FIG. 14) that the auto-rhythm ON/OFF flag RHY is "1", the rhythm tone generation processing in step 900 is executed.

Figure 15:
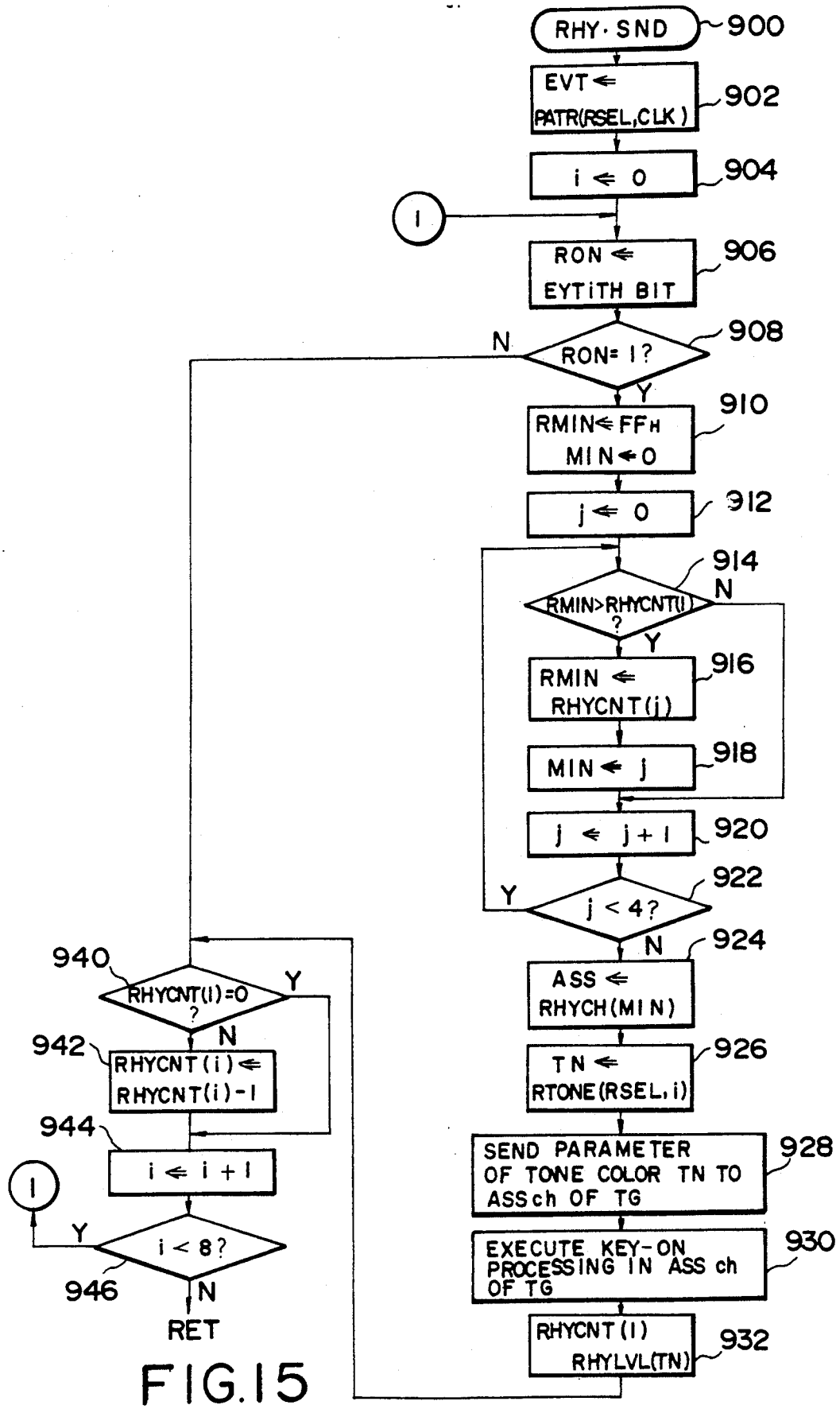
FIG. 15 is a flow chart of rhythm tone generation processing of the electronic musical instrument shown in FIG. 1.

Referring to FIG. 15, rhythm tone generation data at the present timing CLK is read out from the rhythm pattern PATR on the basis of the rhythm type RSEL and the tempo clock CLK and is stored in the register EVT in step 902. In step 904, the control variable i is set to be "0". In steps 906 and 908, an ith bit of the tone generation data EVT is checked. If the ith bit is "1", the flow advances to step 910. In step 910, data $FF_H$ as a maximum value is set in the minimum tone level register RMIN, and data "0" as an initial value is set in the minimum level part register MIN. In step 912, the control variable j is set to be "0". In step 914, the minimum tone level RMIN is compared with the present tone level RHYCNT(j) of a part j. If the present tone level RHYCNT(j) is smaller than the minimum tone level RMIN, the present tone level RHYCNT(j) is stored in the register RMIN as a new minimum tone level in step 916, and a number j of a part having a lower tone level is stored in the register MIN. The flow then advances to step 920. If "NO" in step 914, since the content of the register RMIN corresponds to the minimum tone level, the processing operations in steps 916 and 918 are skipped, and the flow directly advances from step 914 to step 920.

In step 920, the variable j is incremented by one. If it is determined in step 922 that j is smaller than 4, the flow returns to step 914. More specifically, in the loop processing in steps 914 to 922, one having a lowest level of four parts 0 to 3 to which rhythm tones are presently assigned is searched.

If a part MIN having a lowest level is found, the tone generation channel number RHYCH(MIN) to which this part is assigned is read out in step 924, and is stored in the key-on channel register ASS. Thus, the tone generation channel ASS to which a rhythm tone to be generated at the present timing should be assigned is determined. Note that in this embodiment, eight rhythm instrument tones corresponding to 8 bits can be set. In general, four or more rhythm instruments rarely generate tones at the same time. For this reason, four channels corresponding to four parts are set. When generation of tones of five or more parts is instructed at the same time, assignment is made in a priority order starting from a latest designation.

In step 926, the rhythm tone color table RTONE(RSEL, i) is referred to on the basis of the rhythm type RSEL and a bit number i, and readout tone color data is stored in the tone color register TN. Subsequently, in step 928, the parameter of the tone color TN is sent to the channel ASS of the tone generator 60, and key-on processing of the channel ASS of the tone generator 60 is executed in step 930. In step 932, a rhythm tone decay duration table RHYLVL(TN) is referred to so as to read out a decay duration of the key-on rhythm tone color, and the duration is stored in a present tone level counter RHYCNT(j). Thereafter, the flow advances to step 940.

In step 940, the count value of the present tone level counter RHYCNT(i) is checked. If the count value is not "0", it is decremented in step 942, and the flow then advances to step 944. If the count value is "0", since the minimum level has already been reached, step 942 is skipped without decrementing the count value, and the flow advances to step 944.

In step 944, the variable i is incremented by one so as to check the next bit. If it is determined in step 946 that the variable i is smaller than 8, since unchecked bits still remain, the flow returns to step 906. The processing in steps 906 to 946 is repeated. If it is determined in step 946 that the variable i is equal to or larger than 8, since all the 0th to 7th, e.g., eight bits are checked, the flow returns to original processing (step 804 in FIG. 14).

11. ABC Tone Generation Processing

If the automatic accompaniment ON/OFF flag ABC is "1" in step 804 in the tempo interruption processing (FIG. 14), ABC tone generation processing in step 950 is executed.

Figure 16:
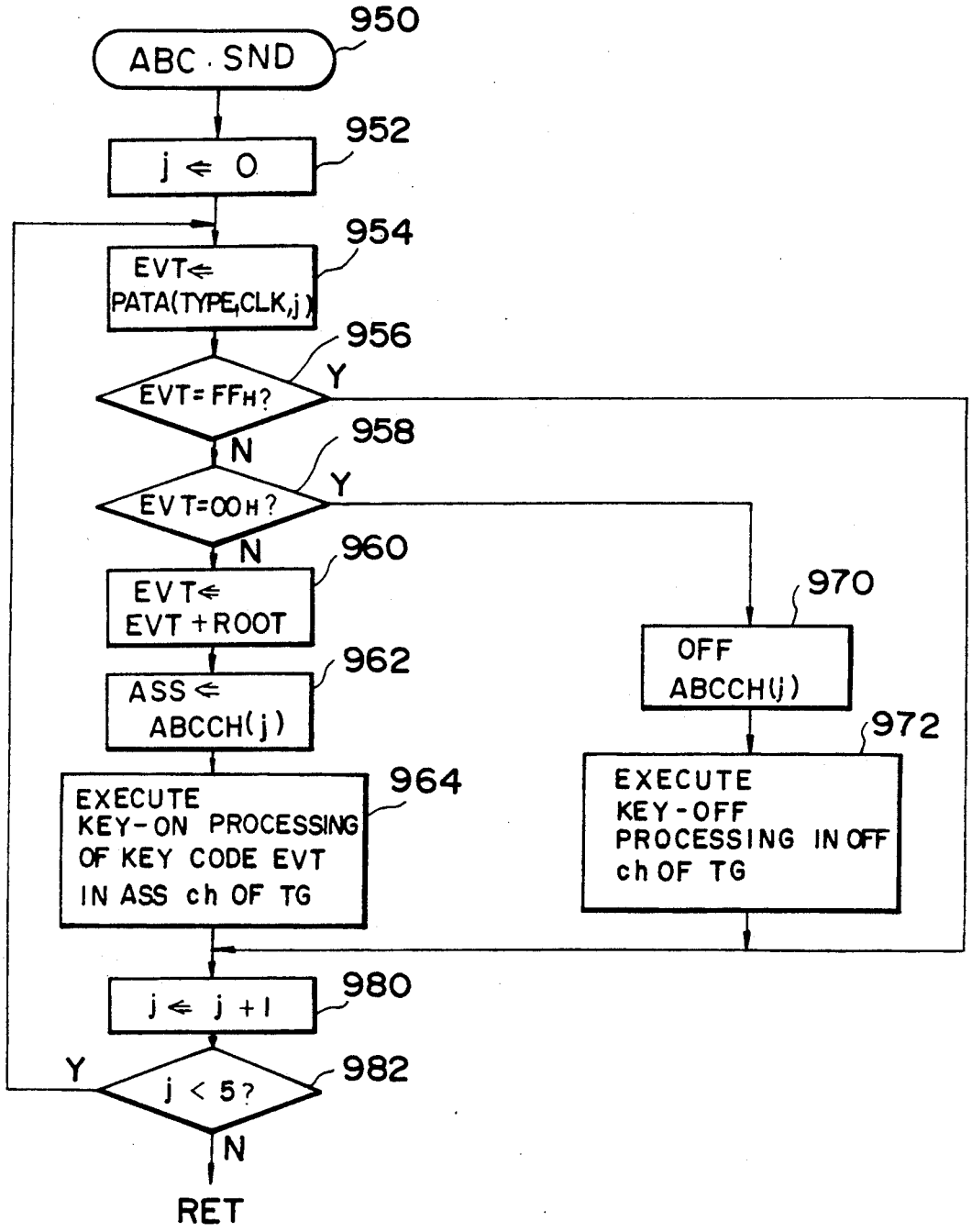
FIG. 16 is a flow chart of ABC tone generation processing of the electronic musical instrument shown in FIG. 1.

Referring to FIG. 16, the control variable j is set to be 0 in step 952, and ABC tone generation data of a part j at a present timing CLK is read out from the ABC pattern PATA on the basis of the rhythm type RSEL, the chord type, the tempo clock CLK, and the part j, and is stored in the tone generation data register EVT. Thereafter, it is checked in step 956 if the tone generation data EVT is $FF_H$. Since $FF_H$ of the tone generation data EVT means no event, the flow directly advances to step 980 without performing any processing for the part j. If the tone generation data EVT is other than $FF_H$, it is checked in step 958 if the data EVT is $00_H$ (key off).

The tone generation data EVT of neither $FF_H$ nor $00_H$ is a key code (halfnote count data from the root ROOT) representing a key-on event. In this case, the root data ROOT is added to the tone generation data EVT in step 960 to convert it into absolute pitch data. In step 962, a number ABCCH(j) assigned to the part j is read out and is stored as the tone generation assignment channel ASS. In step 964, the key-on processing of the key code EVT is executed in the channel ASS of the tone generator 60. Thereafter, the flow advances to step 980.

If "YES" in step 958, that is, if the tone generation data EVT of the part j indicates a key-off event ($00_H$), the number ABCCH(j) of a channel assigned to the part j is read out, and stored in the key-off channel register OFF, in step 970. In step 972, key-off processing of the channel OFF of the tone generator 60 is executed, and the flow then advances to step 980.

In step 980, the variable j is incremented by one in order to read out tone generation data of the next part. If it is determined in step 982 that the variable j is smaller than 5, since unreadout parts still remain, the flow returns to step 954, and the processing in steps 954 to 982 is repeated. However, if it is determined in step 982 that the variable j is equal to or larger than 5, since all the five parts are checked, the flow returns to original processing (step 806 in FIG. 14).

Modification of Embodiment

Note that the present invention is not limited to the above embodiment, and various changes and modifications may be made within the spirit and scope of the invention.

For example, in the above embodiment, a tone generation state at each timing of a thirty-second note is stored as data and is used as rhythm and ABC patterns. In place of this, an event type format pattern consisting of event generation timing data and key-on and key-off event content data may be used.

What is claimed is:

1. An electronic musical instrument, comprising:

key depression information generating means for generating key depression information responsive to key depression;

pattern information generating means for generating pattern information of automatic rhythm performance;

instruction means for instructing pattern information generation;

tone generating means having a plurality of tone generating channels for generating musical tones according to both said key depression information and said pattern information, said channels ordinarily being used for key depression corresponding tones;

selecting means for selecting at least one tone generating channel for automatic rhythm performance from said tone generating channels responsive to instructions of said instruction means to generate pattern information; and assigning means for assigning pattern information to a tone generating channel selected by said selecting means;

wherein each tone generating channel selected by said selecting means is designated for automatic rhythm performance as long as said assigning means has pattern information to assign.

2. An instrument according to claim 1, wherein said selecting means selects said at least one tone generating channel in the order of empty channels which are each not generating any tone, key-off channels which are each generating a key depression corresponding tone in spite of a release of key depression, and key-on channels to each of which key depression information is assigned and which generate a key depression corresponding tone, the key-off channels being further selected in an order of more decayed amplitude of generating tone and key-on channels being further selected in an order of more decayed amplitude of generating tone.

3. An instrument according to claim 1, wherein a particular key-on data of an automatic rhythm tone as one of said pattern information is assigned to a particular one of said tone generating channels selected for automatic rhythm performance every time said particular key-on data is generated.

4. An electronic musical instrument, comprising:

plural keys;

a key information generator which generates key depression information corresponding to a manual tone when at least one of the keys is depressed;

an automatic rhythm performance selector by which automatic rhythm performance may be selected;

a pattern information generator which generates pattern information for automatic rhythm performance;

a tone generator comprising plural tone generation channels, each of which normally is used to generate manual tones but is capable of being used to generate automatic rhythm performance tones;

a tone generation channel selector which, responsive to selection of automatic rhythm performance by the automatic rhythm performance selector, selects at least one tone generation channel from the plural tone generation channels to generate automatic rhythm performance tones; and an assignor which assigns pattern information to a selected tone generation channel;

wherein when stopping of automatic rhythm performance subsequently is designated, each tone generation channel selected for automatic rhythm performance is designated to return to normal use for generation of manual tones.

* * * * *